US006417499B2

(12) United States Patent
Blaker et al.

(10) Patent No.: US 6,417,499 B2
(45) Date of Patent: Jul. 9, 2002

(54) DIELECTRIC HEATING USING INDUCTIVE COUPLING

(75) Inventors: Glenn Craig Blaker, North Vancouver; Terry Albert Enegren, Vancouver, both of (CA)

(73) Assignee: Heatwave Drying Systems Ltd., Crescent Valley (CA)

( * ) Notice: Subject to any disclaimer, the term of this patent is extended or adjusted under 35 U.S.C. 154(b) by 0 days.

(21) Appl. No.: 09/610,878

(22) Filed: Jul. 6, 2000

(51) Int. Cl.[7] ..... H05B 6/48
(52) U.S. Cl. ..... 219/778; 219/770
(58) Field of Search ..... 219/778, 775, 219/774, 771, 770, 780; 99/358

(56) References Cited

U.S. PATENT DOCUMENTS

| | | | | |
|---|---|---|---|---|
| 2,304,958 A | | 12/1942 | Rouy | |
| 2,491,687 A | * | 12/1949 | Nutt | 219/771 |
| 2,732,473 A | | 1/1956 | Ellsworth | |
| 2,842,650 A | * | 7/1958 | Naylor et al. | 219/775 |
| 5,553,532 A | * | 9/1996 | Luz-Martinez et al. | 99/358 |
| 5,641,423 A | * | 6/1997 | Bridges et al. | 219/770 |
| 5,796,042 A | | 8/1998 | Pope | |
| 6,080,978 A | | 6/2000 | Kwan | |

FOREIGN PATENT DOCUMENTS

| | | |
|---|---|---|
| EP | 1058073 | 6/1995 |
| JP | 55001931 | 1/1980 |

OTHER PUBLICATIONS

Search Report PCT/CA01/00929.

* cited by examiner

*Primary Examiner*—Teresa Walberg
*Assistant Examiner*—Quang T Van
(74) *Attorney, Agent, or Firm*—C. A. Rowley

(57) ABSTRACT

A method and apparatus for heating or drying material by applying radio frequency (RF) power to a material in a resonant cavity; wherein an RF power source is inductively coupled to a resonant cavity formed by distributed inductance in resonance with the applicator and material where the magnetic field established by the feed line(s) induces a voltage on the applicator permitting feed line voltages delivering said RF power to the cavity to be lower than those that would normally be encountered for equivalent RF heating using direct coupling.

8 Claims, 3 Drawing Sheets

DIELECTRIC HEATING USING INDUCTIVE COUPLING

FIELD OF THE INVENTION

The present invention relates to radio-frequency (RF) dielectric heating or drying; more specifically, the present invention relates to an improved system for coupling the RF power source to the applicator that allows improved electric field special uniformity and significantly reduced risks of catastrophic arcing failures.

BACKGROUND TO THE PRESENT INVENTION

In the present day application of radio RF power to a typical applicator (otherwise often referred to as the electrode or capacitance plate) used in dielectric heating applications, the RF generator is connected to the applicator by the well-known method of "Direct Coupling". In "Direct Coupling", the RF power is connected directly to the applicator and circulating currents (properties of generating electric fields) travel back from the RF applicator through the feed lines (including any feedthroughs), and back to the output sections of the RF generator or optionally a matching network (if a matching network is being used). The feedthroughs are the location where the incoming RF power feed lines pass into the heating system housing or the like.

Because of the inherent inductance of the RF feed lines and feedthroughs between the RF generator/matching network and applicator, operating at higher RF power levels produces higher circulating currents that often result in very high voltages to be generated on the RF feed lines, at the feedthroughs, and back to the output sections of the RF generator/matching network in direct-coupled applications.

With higher RF voltages on the feed lines, at the feedthroughs, and at the output sections of the RF generator/matching network (which can exceed 10 kV in typical dielectric heating applications), there are increasing risks of catastrophic arcing failure. With extremely high RF voltages (in excess of 50 kV), catastrophic failure is typically imminent in dielectric heating applications. In addition to the risk of calasioplic failures, it is often difficult/impossible or very expensive to find/design RF components that can withstand very high RF voltages in the feedthroughs, feed lines, and the output sections of the RF generator/matching networks. In direct-coupled applications where the RF voltage can become extremely high, the only reasonable solution to prevent catastrophic failure is to reduce the RF power output. However reducing RF power output also reduces process throughputs of the heating/drying system, which is often unacceptable to the process operator. The above-described problems have often resulted in RF power being perceived as not suitable for many otherwise suitable applications.

In a special application of RF power used in high-energy physics particle accelerators, an alternative method of coupling called "Inductive Coupling" is known to be used for the sole application of generating electric fields to accelerate particles such as protons and electrons. "Inductive Coupling" as employed in particle accelerators incorporates distributed inductance in resonance with the applicator strictly to reduce feed line voltages and create the appropriate resonant frequency but not to shape the electric fields. In these applications, the RF power is transferred to the applicator using the well-known principle of mutual coupling where the magnetic field established (by the feed line(s)) induces a voltage on the applicator. Furthermore to Applicant's knowledge, inductive coupling as described above has never been applied to systems for dielectrically heating or drying materials in the electric fields.

With "Inductive Coupling", the circulating current path changes significantly from "Direct Coupling"; there is significantly less circulating current flowing in the feed line(s) directly connected to the applicator and very significant circulating current flows are created from the applicator through the distributed inductance section to ground potential. A benefit of this arrangement found by the Inventors and described below is a reduction in circulating current flow drastically reducing the voltages seen on the feed lines, feedthroughs, and output sections of the RF generator/matching networks.

With inductive coupling in particle accelerators, the RF applicator surface is typically circular and very small (less than 30 cm in circumference). In some cases, the applicator can be much longer but is generally less than 5 cm wide. In all cases, the inductively coupled RF applicators are non-movable, much too small to be suited for more industrial dielectric heating applications, and designed specifically for accelerating particles.

Notwithstanding these perceived limitations, the present invention presents a novel approach to expand "Inductive Coupling" into dielectric heating applications.

BRIEF DESCRIPTION OF THE INVENTION

It is an object of this invention to provide an improved RF heating or drying system.

It is a further object of the invention to provide a method and apparatus for RF heating or drying incorporating inductive coupling.

It is yet another object of the invention to provide a flexible electrical connector for connecting an applicator to an RF source in an RF heating system.

Broadly the present invention relates to a method and apparatus for heating or drying material by applying radio frequency (RF) power to said material in a resonant cavity; the improvement comprising inductive coupling an RF power source to said resonant cavity formed by at least one feed line delivering said RF power, a distributed inductance in resonance with an applicator, said applicator and said material and generating a magnetic field that induces a voltage on said applicator permitting voltages on said feed line(s) delivering said RF power to said cavity to be lower than those that would normally be encountered for equivalent RF heating using direct coupling.

Preferably said generating a magnetic field comprises using said distributed inductance to form a conducting loop with said feed line(s).

Preferably said distributed inductance shapes the electric field within said cavity to provide a uniform electric field intensity applied to said material.

Broadly, the present invention relates to a radio frequency heating system comprising a grounded conductive chamber an applicator in said chamber, said applicator including conductive electrodes, means connecting said applicator to a source of radio frequency power and a distributed inductance means connecting said applicator to the chamber.

Preferably, said chamber comprises a grounded conductive box having a pair of opposed side walls and a bottom and a top wall, said applicator extending laterally of said box, between said side walls, and said distributed inductance means connecting said applicator to its adjacent of said side walls.

Preferably said distributed inductance means comprises a pair of distributed inductance sections one of said distributed inductances sections connecting one side of said applicator to the adjacent side of the chamber and another of said pair of distributed inductance sections connecting a side of said applicator remote from said one side to the adjacent side of the chamber.

Preferably each of said inductance sections has a first portion connected to its end of said applicator, a second portion connecting said first portion to a third portion which is connected to its adjacent said side walls. Preferably, said applicator is hollow and may have perforations for hot air connecting a surface of said applicator facing said material to a hollow interior of said applicator.

A flexible feed line for connecting radio frequency power from a feedthrough to an applicator, said feed line comprising a plurality of wire bundles woven together to form a hollow cylindrical braid connector having an outer surface, more than 20% of the area of said surface being formed by said wires and less than 80% of said surface by air, said air and wire areas being symmetrically uniformly positioned over said surface and collectively establishing a known inductance. The maximum amount of surface area occupied by the wires may approach 100% depending of the flexibility required of the connector, which is dependent on the flexibility and the fineness of the wires Preferably each said bundle comprises between 3 and 10 wires in side by side relationship.

Preferably said hollow cylindrical braid has an elliptical cross section.

BRIEF DESCRIPTION OF THE DRAWINGS

Further features, objects and advantages will be evident from the following detailed descriptions of the present invention taken in conjunction with the accompanying drawings, in which.

DESCRIPTION OF THE PREFERRED EMBODIMENTS

Figure 1:
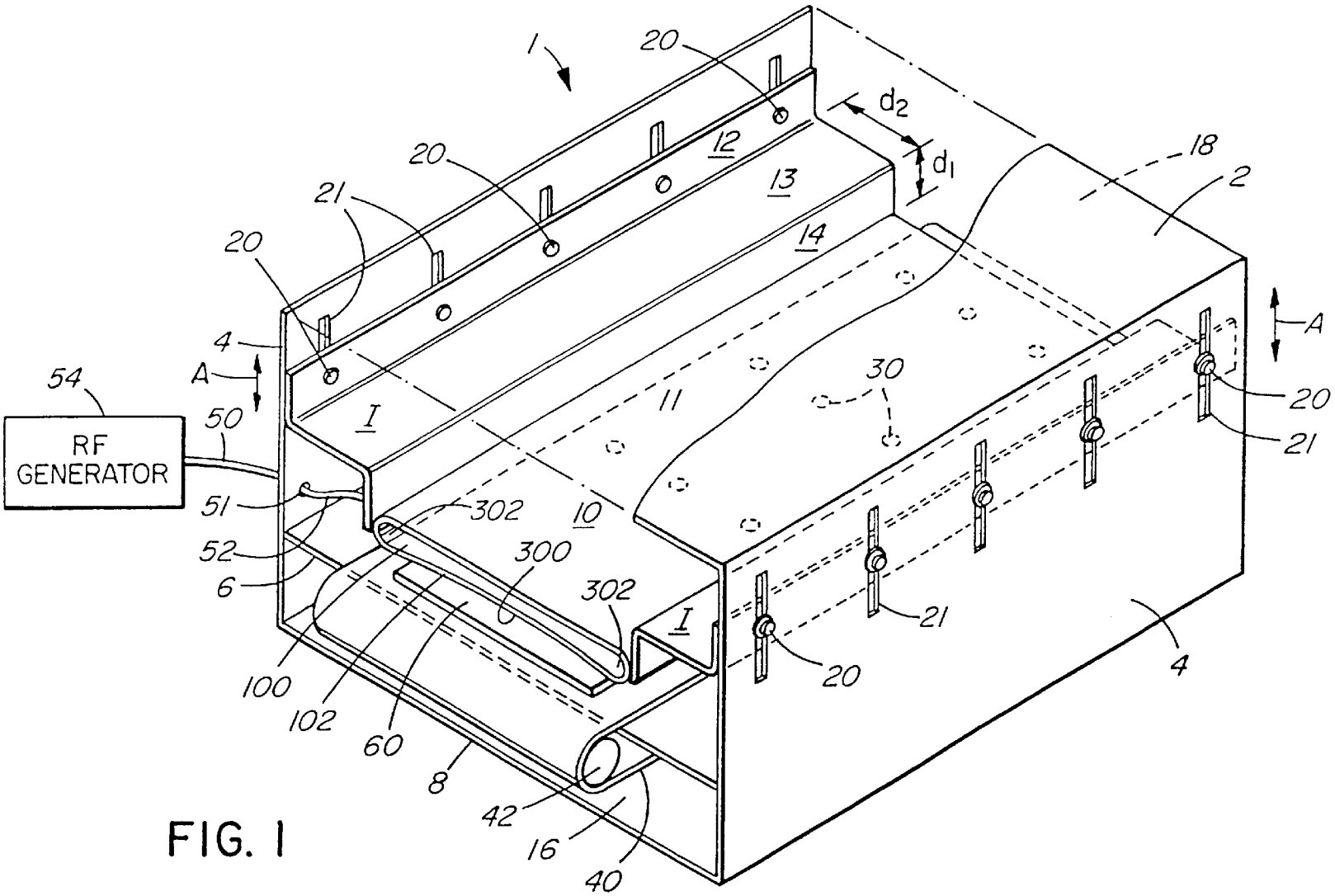
FIG. 1 is a schematic isometric view of an RF heating system (with parts removed for clarity) incorporating the present invention.

When the heating process requires fast processing times and high throughputs, higher radio frequency (RF) electric fields (greater than 10 kV/cm) may often be required. Direct coupling in this situation becomes difficult due to high circulating currents that often result in extremely high RF voltages on the feed lines, feedthroughs, and output sections of the RF generator/matching networks. In addition to the associated high risks of arcing and catastrophic failure (as commonly experienced by others in the past), designing components able to withstand these high voltage requirements is cost prohibitive and at times, impossible.

The RF applicator required for dielectric heating on a commercial basis, for example in food-related dielectric heating applications, needs to be of a substantially larger width and total area than any previous commonly-used inductive coupled applications in particle accelerators (i.e. in the order of at least about 5 square meters) which presents a more significant problem in ensuring RF field uniformity. Some additional items affecting the creation of the proper resonant frequency and affecting RF field uniformity in dielectric heating applications include applicator geometry/size/position, a range of material dielectric properties, the range of material thicknesses typically being processed, and the range of air gaps between the bottom of the RF applicator and the top surface of the material being processed. For optimum field uniformity, some method of electric field shaping is required.

Electric field shaping in this invention can be accomplished in three ways: via defining the shape of the bottom of the RF applicator as done to some very limited extent by those skilled in the past; via defining the number and placement of RF connections as done to some very limited extent by those skilled in the art; and via a new method of defining the shape and sizes of the distributed inductance which is described in more detail herein below. As will be described below, a combination of these three ways is preferable, but not necessarily employed in practicing the preferred embodiment of this invention.

The uniformity of the electric field is directly related to the uniformity of the dielectric heating of the material. For the majority of materials and applications, uniform heating is critical to optimize the process. With heating non-uniformity with many materials, serious product quality issues arise relating to overheating, under-heating, and the like.

This distributed inductance RF heating system can be used for any materials that can be dielectrically heated (i.e. with a loss tangent greaten than approximately 0.005) which includes but is not limited to a variety of food products, solid wood and engineered wood products, building materials, waste materials, ceramics, powders, and plastics.

Surprisingly, the applicant has found that, the electric field uniformity on the inductively coupled applicator with a single RF feed line was also significantly more uniform when compared with the electric field uniformity on the directly coupled applicator with a single RF feed line.

Dielectric field uniformity is an important factor in determining the uniformity of heating of the material being heated or dried. The better the electric field uniformity, the better the heating uniformity when drying and heating. Depending on the material being heated/dried (very process specific), optimum electric field uniformity may range from preferable to mandatory.

The RF application in commercial applications to which the present invention is to be applied must be able to deal with a dirty and dusty environment much less perfect from an RF perspective than the much cleaner environments encountered in particle acceleration applications. In comparison to the previous particle accelerator inductive coupling applications, the dielectric heating applications have a much more stringent requirement to have lower RF voltages to prevent catastrophic arcing because of this much dirtier environment.

Also unlike particle accelerator applications, which do not have variable products placed into the electric fields being generated, optimized dielectric field applications of the present invention must accommodate product non-uniformities/differing products and shaping of the electric fields is a necessity for optimum performance.

However, with proper RF coupling as disclosed hereinbelow, many applications can now benefit from RF dielectric heating using radio frequencies ranging between 1–100 Mz but more practically, the preferred radio frequency range is between 6–45 MHz. The term "resonant cavity" means an enclosed cavity that resonates or is tuned to a specific radio frequency and is defined by all aspects of the chamber, applicator, and distributed inductance. The resonant cavity will have a certain resonant frequency governed by most if not all aspects of the chamber, applicator and distributed inductance including all aspects of the distributed inductance: shape/size, the combined inductance of the RF feed lines to the applicator, the dielectric properties of the material, and the gap between the material and the applicator and the thickness of the material being heated.

A variable height applicator and differing material shapes/properties make the resonant cavity application of the present invention difficult.

As is well known, if an RF power source is applied to a resonant cavity at its resonant frequency, the cavity will "accept" 100% of the RF power if it is properly coupled. The further the RF power source frequency is from the resonant frequency of the cavity, the less RF power will be absorbed by the cavity/material and the more RF power will be reflected back to the RF power source. The specific characteristics of the resonant cavity (whether it forms a "High Q" or "Low Q") affects how close the RF power frequency needs to be to the resonant cavity frequency—"High Q" requires a very close matching of frequencies while "Low Q" applications have a little more flexibility in regards to the RF source frequency.) If required for a particular application, the resonant frequency of the cavity can be tuned by changing the inductance in the cavity thereby changing the resonant frequency. Resonant frequency tuning is well-known in distributed inductance applications in particle accelerators.

Although not limited in this invention, for almost all variants of dielectric heating applications, d1 will range from 15 cm to 1.5 m and d2 will range from 10 cm to 60 cm.

A resonant cavity is created with distributed inductance in resonance with the applicator. The applicator's capacitance is governed by the properties of the material being heated, the air gap between the bottom of the applicator and the top of the material, and size/shape/composition of the applicator. The corresponding inductance in a resonant cavity is created with the inductance of the RF feed lines in combination with the combined distributed inductance. Although the distributed inductance configuration options outlined in this application (including optional rounded edges shown in the pictures) represent the most typical and standard distributed inductance shape that would typically be used in all dielectric heating processes, one skilled in the art can likely develop a different shape to achieve the same inductance. For example, in the Applicants' initial design discussed in detail, their distributed inductance equals approximately 0.03 micro Henry. The distributed inductance required generally depends on the material properties, applicator size/shape, and operating frequency. Although not limited in this invention, the distributed inductance for the typical dielectric heating applications will be less than 1.0 micro Henry's and will be preferably shaped as outlined but can come in a variety of shapes outside of what is provided as long as the appropriate level of inductance is created.

As schematically illustrated in FIG. 1, the heater or drier of the present invention is particularly suited to RF heating of material with a high power electric field. One embodiment of the drier or heater of the invention is formed by a grounded, conductive, metal box structure 1 having a top or roof 2, two walls 4 and a box bottom 8 (all preferably made of aluminum) defining a hollow tube 1 with, in most applications, open ends 16 and 18. In the illustrated arrangement, within the open-ended box 1 is a conductive metal conveyor belt 40 that passes over a conductive metal floor 6 separator (also preferably aluminum). A belt drive unit 42 drives the conveyor belt 40 and may be positioned within the box 1 as shown or the belt may extend beyond the open end(s) of the box 1 and the drive unit 42 could be positioned outside of the box 1.

The material 60 to be dielectrically heated is continuously fed via the moving belt 40 under the RF applicator 10 however this invention is not limited to continuous RF applications; this invention can also be used for batch heating and drying with suitable modifications made by one knowledgeable in the art. The chamber geometry is not limited to that shown; variations in size, shape or orientation will be made depending on the requirements of the specific application.

The RF applicator 10 in the embodiment shown in FIG. 1 is connected to the grounded metal box structure 1 via a pair of distributed inductance (electrically conductive shaped connectors) sections 1, each formed of three portions 12, 13, & 14 (all preferably aluminum or other high conductivity materials). The combination of these three portions provides "distributed inductance" to the system. One "distributed inductance" section I is positioned on each side of the applicator 10 i.e. one connected adjacent to each lateral edge 11 of the applicator 10. In the illustrated arrangement, the first section 14 with depth d1 and extends upward from the applicator 10, a second portion 13 is substantially perpendicular to the first portion 14 and has width d2 that spans the distance to the adjacent wall 4 and a third portion 12 is parallel with and in contact with its respective adjacent wall 4.

It will be noted that a conducting loop is from the RF power input via feed line(s) 52 (discussed below), the distributed inductance section(s) I, possibly the applicator 10 in some implementations depending on the level of coupling required for the specific application (not illustrated in this particular implementation), and back to the box 1 i.e. to the adjacent side wall 4. This loop is designed to generate a magnetic field that induces an RF voltage on the applicator 10, which generates an electric field that heats the material 60. In the illustrated arrangement, the feed lines are connected to the distributed inductance I; they may also be directly connected to the applicator 10.

The present invention is not dependent on any specific details on how the magnetic field is established and used to induce the voltage on the applicator 10. The system described above is preferred. Another known system used in particle accelerators, in fact the most common system used in particle accelerators, has the feed line for the RF power shaped into a "loop" and the RF feed line end is connected to ground potential e.g. the side of the box 1. The magnetic field generated on this "loop" is coupled to the magnetic field of the distributed inductance section connected to the applicator; this configuration induces a voltage on the applicator 10.

In the illustrated arrangement, there is one distributed inductance section I at each side of the applicator. More or less (or in different shapes) may be employed, however it has been found that a more uniform electric field distribution is attained when only two such distributed inductances positioned one on each side of the applicator are employed.

The exact size and shape of the inductance section I is not critical for this invention; one skilled in the art can design distributed inductance in a variety of shapes and sizes to achieve the required inductance for any specific resonant frequency desired.

The portions 12 are each bolted to their respective wall 4 by a plurality of bolts 20 received in slots 21 in their respective wall 4 to permit adjustment of the height of the applicator 10 as will be described below.

It is important that no part of the electric field generating side of the distributed inductance section I (bottom in this case) violates the minimum radius rule as taught in applicants earlier U.S. Pat. No. 5,942,146 issued Aug. 24, 1999. (the teachings of which are incorporated herein by reference); namely that the electrical connector have a minimum curvature on its outside surface having a radius of at least r to prevent arcing of the connector and where r is defined by $$r>=\tfrac{1}{5}\{[(E_{BD})(D)/V_{MAX}]-22\}$$

Where r and D are in centimeters (cm)

$V_{MAX}$ is in volts $E_{BD}$ is in volts/cm

The shape of the section I is preferably as illustrated. The use of an imperfect Z shape in section I changes the resonant cavity frequency and therefore d1 and/or d2 typically need to be compensated.

As schematically illustrated in FIG. 1, the height of the RF applicator 10 is adjustable as indicated by arrow A by loosening the bolts 20 and positioning them as desired in their respective slot 21 in the walls 4 and then retightening them in the adjusted position. This height adjustment system allows all the height adjustment components to be located outside of the system and outside of any electric fields.

The distributed inductance section I must provide a continuous connection to the grounded walls 4 to ensure a strong electrical connection for the high circulating currents that will be encountered.

The dimensions d1 and d2 are critical and affect the resonant cavity frequency. Those familiar with the art understand how these dimensions are selected to define the resonant cavity frequency however; the distributed inductance is not the only factor influencing the resonant cavity frequency. The resonant cavity frequency is also affected by the geometry of the applicator (primarily its width and length), the range of distances between the bottom of the applicator to ground, the range of air gaps between the applicator and the material 60 in the electric field, the range of the material's dielectric constant, the number of and the inductance of the RF connectors attached to the RF applicator. There is no simple equation or rule governing the resonant cavity design—extensive coIiputeI, modeling and laboratory/field testing of all these combined factors is required to achieve the desired results.

It is important that the connections of sections 12, 13 and 14 be sufficiently large and continuous to handle the high circulating currents.

It will be apparent that a given system is not likely to be suitable for all materials and that depending on the change in the dielectric properties of the material to be heated and the Q of the circuit, a given system may be suitable "as is", require inductive tuning, or possibly may have to be completely redesigned if the change is very substantial.

Figure 2:
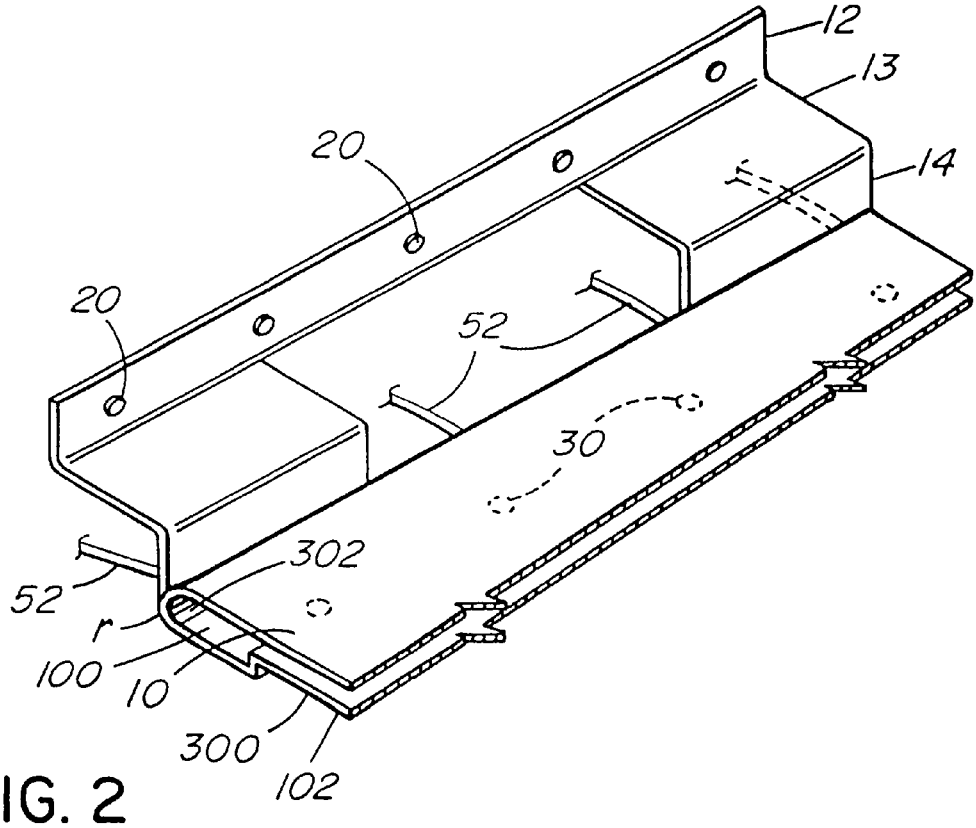
FIG. 2 and FIG. 3 are schematic isometric illustrations of alternative sections of the hollow electrode structure and distributed inductance for use with the present invention.
Figure 3:
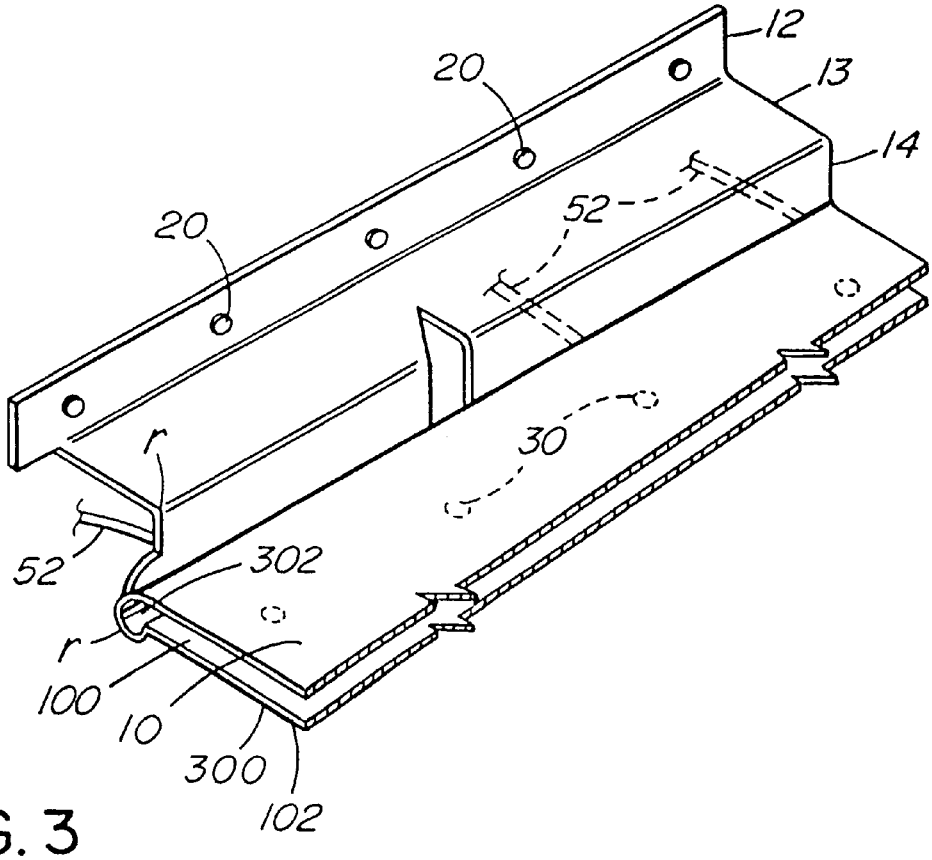

FIG. 2 and FIG. 3 illustrate some further RF applicator and distributed inductance considerations. As taught in applicants earlier U.S. Pat. No. 5,942,146 issued Aug. 24, 1999 all edges in a electric field such as the edges 11 must be radiused as indicated by radius r sufficiently large to ensure all local electric field intensities are minimized. For fast RF heating of material such as the food products in the inventors' implementation, the minimum radius r is 5 cm.

As will also be observable in FIG. 2, the distributed inductance is composed of three sections 12, 13, 14 made up of discrete lengths i.e. the sections 13 and 14 and are not necessarily continuous and do not necessarily extend over the full length of the applicator 10.

Shortening or notching and other non-continuous features may be applied to the distributed inductance sections 13 and 14 for further electric field shaping for specific applications. The size and shapes of the shortening, notching and non-continuous features of the distributed inductance sections are determined by trial and error and/or computer modeling These different types of distributed inductance arrangements are as above described used to shape the electric fields. The section 14 used in FIG. 2 is not planar as in FIG. 1 but is smoothly curved to interconnect the applicator 10 with the section 13.

The distributed inductance shown in FIG. 3 with a notch removed and distributed inductance not running the full length of the applicator shows further possibilities that can be used to influence field shaping in inductive coupled applications. All different distributed inductance shapes will affect the flow of the circulating currents and will ultimately shape the electric fields. As is illustrated in FIG. 2 and FIG. 3, the number or location of the flexible feed lines 52 may be varied as desired in inductive coupled applications. In general, optimum electric field shaping will result from a combination of applicator 10 shaping (described below), placement and number of flexible feed lines 52, and distributed inductance shaping section I.

For example, to achieve a resonant frequency of 40.68 MHz in a configuration similar to FIG. 1 with an applicator width of 1.65 m, an applicator length of 3.8 m, an applicator height above the ground plate (i.e. Gap between the top of the material being heated plus the thickness of the material) ranging from 7 cm to 14 cm, material 60 ranging from 7 to 14 cm in height, and material with a maximum dielectric constant of 22 and a maximum loss tangent of 0.41 requires d1=65 cm and d2=17.5 cm.

Feed Lines

An RF generator 54 is connected to the applicator 10 via RF feed lines 50 and 52 (passing through the feedthrough 51). Depending on the selection of RF generating technology, the RF generator 54 may be fed into a matching network (not shown) before the RF power is fed to one or more feed lines 50. Given the adjustable height of the RF applicator 10, a flexible feed line 52 is utilized to connect the feedthrough 51 to the RF applicator 10.

For the purpose of this invention (although not limited thereto), a unique feed line 52 was invented to extend between the feedthrough(s) 51 and the RF applicator 10. This feed line 52 needed to:

1. be able to handle high RF currents (i.e. high conductivity metal such as aluminum or copper);
2. be suitable for the environment (i.e. not corroding);
3. be flexible (more so than the most flexible known coaxial cables); and
4. appear to the electric field to have a minimum radius acceptable to high electric fields as taught in applicants earlier U.S. Pat. No. 5,942,146 issued Aug. 24, 1999; all edges must be radiused sufficiently large to ensure all local electric field intensities are minimized.

As shown in cross section in FIG. 4, the feed line or connector 200 which may be used as the connector 52 described below has a hollow interior 202 and is formed from material shown at 204 in FIG. 5 curved into a circular or preferably an elliptical shape as shown. The industry typically calls the entire piece 204 a "Braid".

The wires 210 are woven together using well known techniques to create a braid connector 204 of the desired shape e.g. a hollow cylinder preferably having an elliptical cross section. i.e. individual wires 210 (typically in groups or bundles 208—between 3 and 10 wires typically 5 wire to a bundle) are interwoven (or braided) together to form a self supporting, hollow tube or braid which is flexible and conductive to RF.

It is important that the minimum radius of the surface of the connector 200 follow the above-described rule for minimum radius r. For most applications the connector is mounted in position with the major axis 206 of the connector oriented in a plane substantially perpendicular to the direction of movement of the applicator 10, however in some applications the connector can be compressed to some limited extent lengthwise to accommodate the movement of the applicator.

The braid 204 is formed by weaving the bundles 208 of discrete conductors 210 together so that no single wire can project from the surface and become an antenna, which would cause arcing problems. Each of the bundles 208 includes a plurality of discrete wires in side by side arrangement to form a substantially planar bundle 208 in ribbon like form. These bundles or ribbons are woven together as warp and weft ribbons to form the fabric 204.

The wires 210 must be close enough together in the braid 204 so that they appear as a solid shape to RF. The braided wire fully woven into a cylinder and in its resting self-supporting state before being connected to the applicator (before it could be stretched/compressed), has a surface of the braid that is reasonably tightly woven so that there is approx. 70% visible wire on the surface and 30% air. FIG. 5 is intended to show approx 40% surface wire.

The surface of the braid 204 should be made in such a way that there is at least 20% visible wire on the surface and not more than 80% air. It will be apparent that the air and wire areas should be symmetrically uniformly positioned over the surface of the braid 204.

The bundles or ribbons 208 (made up of 5 individual wires 210 in this case) of wires are interwoven together to form a hollow-cylinder of self-supporting wires that are much more flexible than typical coaxial cables.

Figure 4:
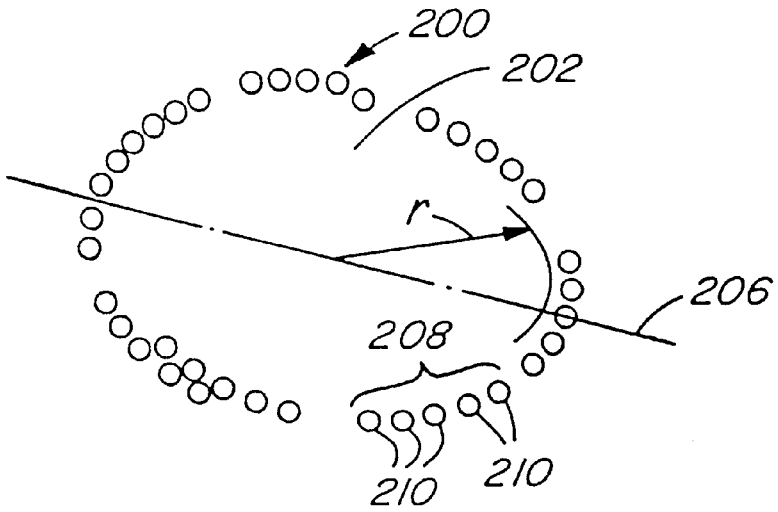
FIG. 4 is an end view of the flexible feed line.
Figure 5:
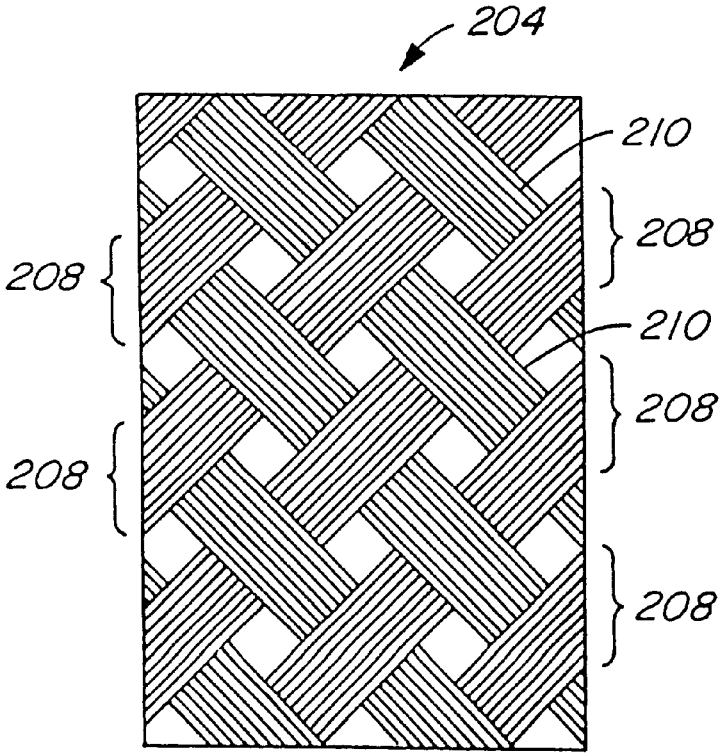
FIG. 5 is a side view of a small section of the flexible feed line.

For example (and as illustrated in FIGS. 4 and 5), it has been found that aluminum braids of five wires 210 each 0.035" diameter conductors (or similar) to form the bundles or ribbons 208 meet the unique requirements for a flexible RF feed line 52 referred to above.

As illustrated in FIG. 1, the applicator 10 may be hollow as indicated at 100 and a multiplicity of spaced perforations 30, preferably uniformly spaced in a pattern, are provided through the bottom 102 of the RF applicator 10 (bottom 102 faces the load 60) so that hot air can be blown into the hollow interior 100 of the applicator 10 and out through the perforations 30 and onto the top surface of the material 60 being dielectrically heated. Any suitable system for delivering hot air to the interior 100 such as a flexible duct (not shown) may be used. If hot air is to assist this process, in all cases over 50% of the heat generated into the material 60 will be delivered from RF dielectric heating and a minority from hot air.

The flexible duct (not shown) must not be electrically conductive and must be able to withstand high temperatures of up to 350 deg. C. likely to be experienced in such a food heating implementation.

To maintain a near-constant electric field over the entire applicator, the applicator bottom surface 102 should be shaped. The applicator bottom surface in FIG. 1 is not flat but is in the form of a flattened V. Other sample applicator bottom surfaces are shown in FIG. 2 and FIG. 3. In all cases the central longitudinal portion of the applicator 10 is spaced farther from the load than the edges 11 for optimum electric field uniformity.

In these applications employing inductive coupling, the electric field will need to be increased at the edges to make the entire electric field uniform. To this end the central portion 300 of the bottom surface is concave and is positioned farther from the surface of the product 60 than edge sections 302.

EXAMPLE 1 (Reduced RF Voltages):

In designing the present food baking system, the Applicants' simulation models showed RF voltages in excess of 200 kV on the feed lines if direct coupling was used at the high RF power levels required for the Applicants' application. With inductive coupling, the Applicants were able to reduce the RF voltages on the feed lines to approximately 10 kV. These simulated results have been confirmed during laboratory scale trials.

EXAMPLE 2 (Optimized Time-Varying Field Uniformity):

In designing the present food baling system, the Applicants' simulation models originally showed less than ideal electric field uniformity when an applicator with a flat bottom surface was first proposed. In the case of this particular proposed applicator shape, higher heating would occur at the center of the material being baked while the edges of the material would be undercooked. With such product non-uniformity, this baking process would be commercially unviable. The Applicants elected to shape the electric fields to be more uniform by centering the single RF feed line to one edge of the applicator, connecting distributed inductance to only two edges of the applicator, and increasing the thickness of two sides of the applicator to increase the effective electric field intensity on the material below those locations. These modifications made the process commercially viable.

Having described the invention, modifications may be evident to those skilled in the art without departing from the spirit of the invention as defined in the appended claims.

What is claimed is:

1. A radio frequency heating system comprising a grounded conductive chamber having chamber walls, an applicator inside the chamber, means coupling said applicator to a source of radio frequency power, a distributed inductance means having a pair of distributed inductance sections one of said distributed inductance sections connecting one side of said applicator to its adjacent chamber wall and another of said pair of distributed inductance sections connecting a side of said applicator remote from said one side to its adjacent chamber wall, and the resulting resonant cavity tuned to a specific radio frequency.

2. A radio frequency heating system as defined in claim 1 wherein said chamber comprises a grounded conductive box having a pair of oppose side walls forming said adjacent chamber walls and a bottom and a top wall, said applicator extending laterally of said box, between said side walls.

3. A radio frequency heating system as defined in claim 2 wherein each of said inductance sections has a first portion connected to its end of said applicator, a second portion connecting said first portion to a third portion which is connected to its adjacent chamber wall.

4. A radio frequency heating system as defined in claim 3 wherein said applicator is hollow and has perforations for hot air connecting a surface of said applicator facing said material to a hollow interior of said applicator.

5. A radio frequency heating system as defined in claim 2 wherein said applicator is hollow and has perforations for hot air connecting a surface of said applicator facing said material to a hollow interior of said applicator.

6. A radio frequency heating system as defined in claim 1 wherein each of said inductance sections has a first portion connected to its end of said applicator, a second portion connecting said first portion to a third portion which is connected to its adjacent chamber wall.

7. A radio frequency heating system as defined in claim 6 wherein said applicator is hollow and has perforations for hot air connecting a surface of said applicator facing said material to a hollow interior of said applicator.

8. A radio frequency heating system as defined in claim 1 wherein said applicator is hollow and has perforations for hot air connecting a surface of said applicator facing said material to a hollow interior of said applicator.

* * * * *

UNITED STATES PATENT AND TRADEMARK OFFICE

CERTIFICATE OF CORRECTION

PATENT NO. : 6,417,499 B2
DATED : July 9, 2002
INVENTOR(S) : Blaker et al

It is certified that error appears in the above-identified patent and that said Letters Patent is hereby corrected as shown below:

Column 1,
Line 42, "calasioplic" should read -- catastrophic --

Column 7,
Line 17, "$r>=1/5\{[E_{BD})(D)V_{MAX}]-22\}$" should read -- $r>=1/\{5[(E_{BD})(D)/V_{MAX}]-22\}$ --
Line 50, "coliiputel," should read -- computer --

Column 10,
Line 23, "baling" should read -- baking --

Signed and Sealed this

Fifth Day of October, 2004

JON W. DUDAS
*Director of the United States Patent and Trademark Office*